US005832849A

United States Patent [19]

Kaetterhenry et al.

[11] Patent Number: 5,832,849

[45] Date of Patent: Nov. 10, 1998

[54] WEB-FED CHAIN-STITCH SINGLE-NEEDLE MATTRESS COVER QUILTER WITH NEEDLE DEFLECTION COMPENSATION

[75] Inventors: Jeff Kaetterhenry, Davie; James T. Frazer, Coral Springs; Glenn E. Leavis, Hollywood, all of Fla.

[73] Assignee: L&P Property Management Company, South Gate, Calif.

[21] Appl. No.: 831,060

[22] Filed: Apr. 1, 1997

[51] Int. Cl.[6] ..... D05B 11/00

[52] U.S. Cl. ..... 112/117; 112/470.13; 112/475.08; 112/221

[58] Field of Search ..... 112/117, 118, 112/119, 155, 475.08, 220, 221, 470.01, 470.12, 470.13

[56] References Cited

U.S. PATENT DOCUMENTS

| | | | |
|---|---|---|---|
| 2,119,341 | 5/1938 | Milner . | |
| 3,559,600 | 2/1971 | Kalning . | |
| 3,871,309 | 3/1975 | Frost . | |
| 3,989,239 | 11/1976 | Scriven, Jr. et al. . | |
| 4,173,191 | 11/1979 | Taddicken . | |
| 4,353,539 | 10/1982 | Doyen et al. . | |
| 4,493,276 | 1/1985 | Sadeh . | |
| 4,664,367 | 5/1987 | Vergnetti . | |
| 4,664,577 | 5/1987 | Bonali . | |
| 4,669,400 | 6/1987 | Michaels et al. . | |
| 5,018,463 | 5/1991 | Nakajima . | |
| 5,040,473 | 8/1991 | Zesch et al. . | |
| 5,103,747 | 4/1992 | Resta et al. | 112/117 |
| 5,136,955 | 8/1992 | Resta et al. . | |
| 5,154,130 | 10/1992 | Gribetz et al. . | |
| 5,287,820 | 2/1994 | Stuznacker | 112/117 |
| 5,425,319 | 6/1995 | Resta et al. . | |
| 5,458,075 | 10/1995 | Tice et al. | 112/221 X |
| 5,640,916 | 6/1997 | Kaetterhenry et al. . | |

*Primary Examiner*—Peter Nerbun
*Attorney, Agent, or Firm*—Wood, Herron & Evans, L.L.P.

[57] ABSTRACT

A quilting machine is provided having at least one set of single needle stitch forming elements for forming chain stitched patterns on a thick multilayered material such as a mattress cover. The machine is preferably web fed, with a panel of the continuous web being clamped and held stationary on a frame. The elements include a needle and a looper mounted on separate heads that are independently moveable transversely on a bridge, which is moveable longitudinally on the frame. The bridge is longitudinally moved by a servo and the heads are transversely moved on the bridge by separate servos. Each head is driven by a separate servo. A controller drives the servos to chain stitch patterns and differentially moves the heads transversely to account for transverse needle deflection. The drives of the needle and looper are phased to compensate for longitudinal needle deflection. The controller stores empirically determined data and responds to control signals or sensors to determine deflection and calculate the needle deflection compensation from which it generates deflection compensation signals to drive the servos.

17 Claims, 5 Drawing Sheets

WEB-FED CHAIN-STITCH SINGLE-NEEDLE MATTRESS COVER QUILTER WITH NEEDLE DEFLECTION COMPENSATION

The present invention relates to the quilting of patterns on multiple layer materials, and particularly to the stitching of 360° patterns on thick multilayer materials such as mattress covers.

BACKGROUND OF THE INVENTION

Quilting is a special art in the general field of sewing in which patterns are stitched through a plurality of layers of material over a two dimensional area of the material. The multiple layers of material normally include at least three layers, one a woven primary or facing sheet having a decorative finished quality, one a usually woven backing sheet that may or may not be of a finished quality, and one or more internal layers of thick filler material, usually of randomly oriented fibers. The stitched patterns maintain the physical relationship of the layers of material to each other as well as provide ornamental qualities. Quilting is performed on the customary quilts or comforters and on the covers of mattresses, for example. In the stitching of quilts for these two applications, two different approaches are typically used. Both approaches use stitches that employ both a top and a bottom thread.

Single needle quilters of the type illustrated and described in U.S. patent application Ser. No. 08/497,727, filed Jun. 30, 1995 U.S. Pat. No. 5,640,916 entitled Quilting Method and Apparatus and those patents cited and otherwise referred to therein are customarily used for the stitching of comforters and other preformed rectangular panels. Such single needle quilters typically use a pair of cooperating lock stitch sewing heads, one carrying a needle drive that is typically positioned above the fabric and one carrying a bobbin that is opposite the fabric from the needle, with both heads being mechanically linked to move together in two dimensions, relative to the panel, parallel to the plane of the panel. A common arrangement of this type of quilting apparatus is to support the panel of fabric on a longitudinally moveable shuttle with the sewing heads moveable transversely of the panel to provide two dimensional stitching capability of the pattern on the panel.

Multiple needle quilters of the type illustrated in U.S. Pat. No. 5,154,130 are customarily used for the stitching of mattress covers, which are commonly formed from multi-layered web fed material. Such multi-needle quilters typically use an array of cooperating double chain stitch sewing elements, one element being a needle that is typically positioned above the material and one element being a looper that is opposite the material from the needle, with the entire arrays of both elements being mechanically linked together to move in unison in two dimensions, relative to the material, parallel to the plane of the material in paths that corresponds to identical patterns of a pattern array. The needles and loopers also operate in unison so that the sets of elements simultaneously form identical series of stitches. A common arrangement of this type of quilting apparatus is to support the panel of multilayered material and feed the material from a web longitudinally relative to the sewing element array and in coordination with the motion and operation of the sewing elements. The sewing element array may be shiftable transversely of the web to provide two dimensional stitching capability of the pattern on a panel length of the web. Alternatively, the array is stationary and rollers that support the web shift transversely relative to the array. Some multi-needle quilters of this type have longitudinally bi-directional web feeding capability which, when synchronized with the transverse shifting of the web or the sewing elements, provides for 360° pattern sewing capability.

The single needle quilters are regarded as preferable for the sewing of a wider range of patterns and particularly more highly decorative patterns. In addition, in single need quilters, the lock stitch is commonly used. Lock stitch machines, with their needle and bobbin arrangement, have been made somewhat able to tolerate or avoid needle deflection problems that can result in a missing of stitches when a needle is deflected. Needle deflection is more of a problem when quilting thick materials and complex patterns that involve many directional changes in the sewing path, particularly where higher sewing speeds are used. The lock stitch also provides equally aesthetically acceptable stitching on both sides of the fabric.

The multi-needle quilters are regarded as preferable for sewing mattress covers. With mattress covers, the less attractive looper side stitch may be confined to the inside of the mattress cover on the backing layer of material that is not visible to the observer. Further, the double chain stitch heads of the multi-needle quilters apply a looper side thread from an external spool, which can accommodate a substantially larger thread supply than can the bobbin of a lock stitch machine. As a result, the lock stitch machine can be run longer before the need arises to replenish the bottom thread supplies. The bobbins of the lock stitch machines require frequent changing, particularly with thick multi-layered materials such as mattress covers which require more thread per stitch. A drawback to the use of double chain stitch machines has been the greater likelihood for stitches to be missed as a result of needle deflection. This is in part because a double chain stitch requires the looper on one side of the material to enter a thread loop in close proximity to the needle that has passed through the material from the other side, which needle itself must pass through a thread loop presented by the looper. Misalignment of the needle and looper due to deflection of the needle can result in the missing of stitches which, in the formation of more highly decorative patterns, is undesirable for not only aesthetic reasons but because it can result in an unraveling of the stitched pattern. Attempts at high speed sewing on mattress covers, where the material is generally very thick and the outer or ticking layer of fabric may be heavy and even of an upholstery-like nature, produce unavoidable needle deflection.

With the increased use of computerized pattern control and the resulting ability to provide a wider variety of quilted patterns, particularly patterns of a high ornamental quality, there has been an increasing demand for an ability to sew, more complex and larger patterns onto the covers of mattresses. To this end, equipment of the prior art such as discussed above has limitations. Accordingly, there remains a need for a capability to stitch more highly ornamental and complex patterns onto mattress covers at high speed.

SUMMARY OF THE INVENTION

An objective of the present invention is to provide a computer controlled pattern quilting method and apparatus that will provide a wide variety of quilted patterns, particularly patterns of a high ornamental quality. A particular objective of the present invention is to provide a quilting method and apparatus employing a single needle quilting head and having the capability of quilting at high speed, particularly on thick materials such as those used for mattress covers.

A further objective of the present invention is to provide a quilting method and apparatus having one or more independently moveable sets of single needle chain stitch quilting heads that will stitch at high speeds, particularly on thick materials. A particular objective of the present invention is to provide such a quilting apparatus and method that does not suffer adversely from needle deflection.

According to the principles of the present invention, a quilting machine is provided with at least one set of chain stitch quilting heads that are independently moveable relative to each other and relative to the material being quilted. The machine is preferably web fed and its method of use preferably includes 360° stitching onto material webs of thicknesses typical of those used for mattress covers. In accordance with the preferred embodiment of the invention, a single-needle double chain stitch quilting method and apparatus are provided with independently operable servo driven quilting heads that are each independently moveable relative to the material being quilted. The heads are preferably also independently movable relative to each other in at least one direction, preferably the transverse direction, and the operation of each of the heads is preferably also independent to allow for effective control of the cooperating positions of the needle and looper relative to each other. In the preferred and illustrated embodiment, the needle and looper heads are independently moved transversely to permit adjustment of the cooperating positions of the needle and looper in the transverse direction and the cycles of the needle and looper heads are relatively phased to allow adjustment of the cooperating positions of the needle and looper in the longitudinal direction.

The relative movements and operation of the heads are brought about by computer controlled servos that move and drive the heads so as to maintain the proper cooperative relationship between the needle and looper in accordance with whatever needle deflection takes place. The needle deflection is preferably determined in advance by empirical measurements and data is stored in memory in a programmable microprocessor-based controller of the quilting machine. The stored measurements may be in the form of a look-up table or sets of formula, constants and/or parameters from which needle deflection compensation signals can be supplied to affect the operation of servo motors driving and moving the heads relative to each other and to the material being quilted. Preferably also, the stored empirical data include alternative data that will provide needle deflection compensation for different conditions, such as different materials and fabrics, needles that differ in size or stiffness, varying stitch speeds and stitch sizes, and or other variables that can have an effect on the amount and direction of needle deflection that is expected to occur or does occur.

In accordance with the preferred embodiment of the invention, a quilting machine is provided with web supplies of the various layers of a mattress cover, which webs are brought together in the form of a multiple layered web and fed onto a machine frame, preferably in a horizontal plane. The frame preferably includes a plural belt conveyor that supports the web and aids in the advancement of the web onto the frame. A pair of side edge grippers, which may be in the form of opposed belt grippers, pin chains, clamping finger sets or other side securements, engage the opposite side edges of the web and move the web onto the frame in synchronism with the operation of the belt conveyor. The machine may optionally be provided with a pair of edge stitching heads to at least temporarily stitch together the layers of material of the portion of the web that is advanced onto the frame. Once on the frame, the edge clamps as well as tension rolls at the front and back of the frame tension a portion of the web for quilting.

The quilting is performed by a pair of heads that are each mounted to a bridge structure that is moveable longitudinally on the frame. The bridge is moveable on the frame by a computer controlled servo motor that positions the set of heads in accordance with the pattern to be stitched. Each of the heads is mounted on the bridge so as to be independently transversely moveable. Each head, including an upper needle head and a lower looper head, is provided with a servo motor drive that drives the respective head through its stitching cycle. The two head drive servo motors are operated in synchronism under computer control to sew series of double chain stitches in the fabric. Each head is mounted to the bridge on a linear servo motor that independently positions the head transversely on the frame under the control of the programmed controller of the machine in accordance with the pattern to be stitched.

Needle deflection is accommodated in one of, and preferably both of, two ways. First, needle deflection is accommodated by providing either a table of correction values, or preferably a correction formula based on several empirical constants, and a program in a memory accessible by a microprocessor of the controller in response to which the controller may vary control signals to the servos to control the positions of the heads relative to each other and the relative operational phases of the heads in a way that will compensate for whatever needle deflection is likely to occur. Second, needle deflection is accommodated by sensing certain machine conditions, such as speed, load or power demand or torque angle of servo motors, needle or looper position, or some other relevant machine condition. The sensing may be provided by reading data already present in the controller, by reading control signals being sent to machine servos and other drive elements or by monitoring various sensors separately provided on the machine to sense machine element status or the properties or states or the material or of the thread.

Preferably, transverse deflection of the needle is provided by differently driving the heads transversely so that the looper and needle align whether or not the needle is deflected transversely. Preferably also, longitudinal deflection of the needle is provided by controlling the relative phases of the head drive servos so that the needle and looper engage at the proper time in the cycle whether or not the needle is deflected longitudinally.

The present invention provides for the high speed quilting of patterns on a web of thick fabric of the type of which mattress covers are made. A double chain stitch is sewn without the stitch quality being adversely affected by needle deflection, because servos drive the heads to provide for precise relative positioning. As a result, large spools of lower thread may be provided, eliminating the need to replenish bobbin thread supplies as would be the case with lock stitch machines. Overall higher operating speed and throughput is obtained.

These and other objects of the present invention will be more readily apparent from the following detailed description of the drawings in which:

DETAILED DESCRIPTION OF THE PREFERRED EMBODIMENT

Figure 1:
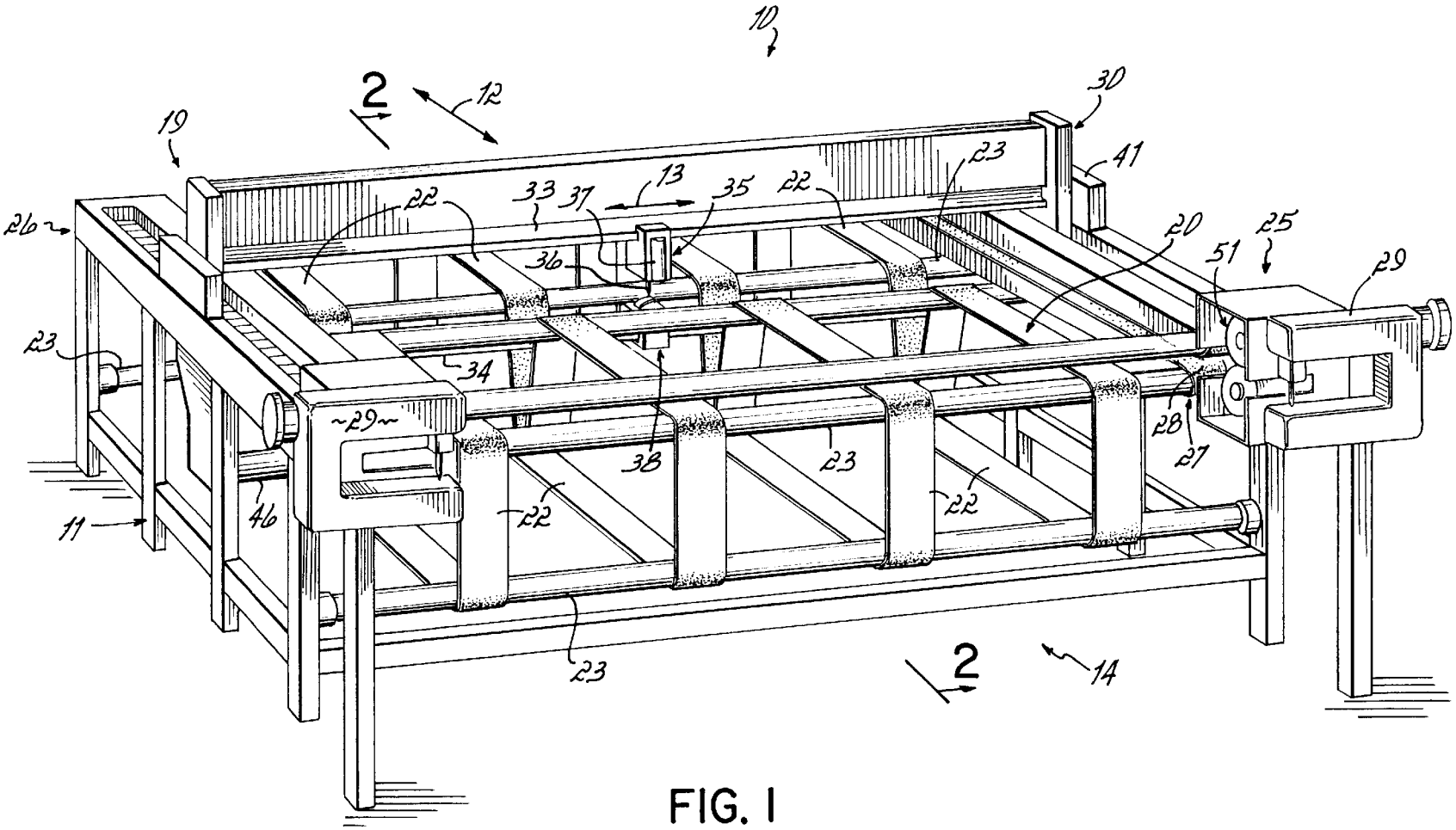
FIG. 1 is a perspective view of a web-fed mattress cover quilting machine embodying principles of the present invention.
Figure 2:
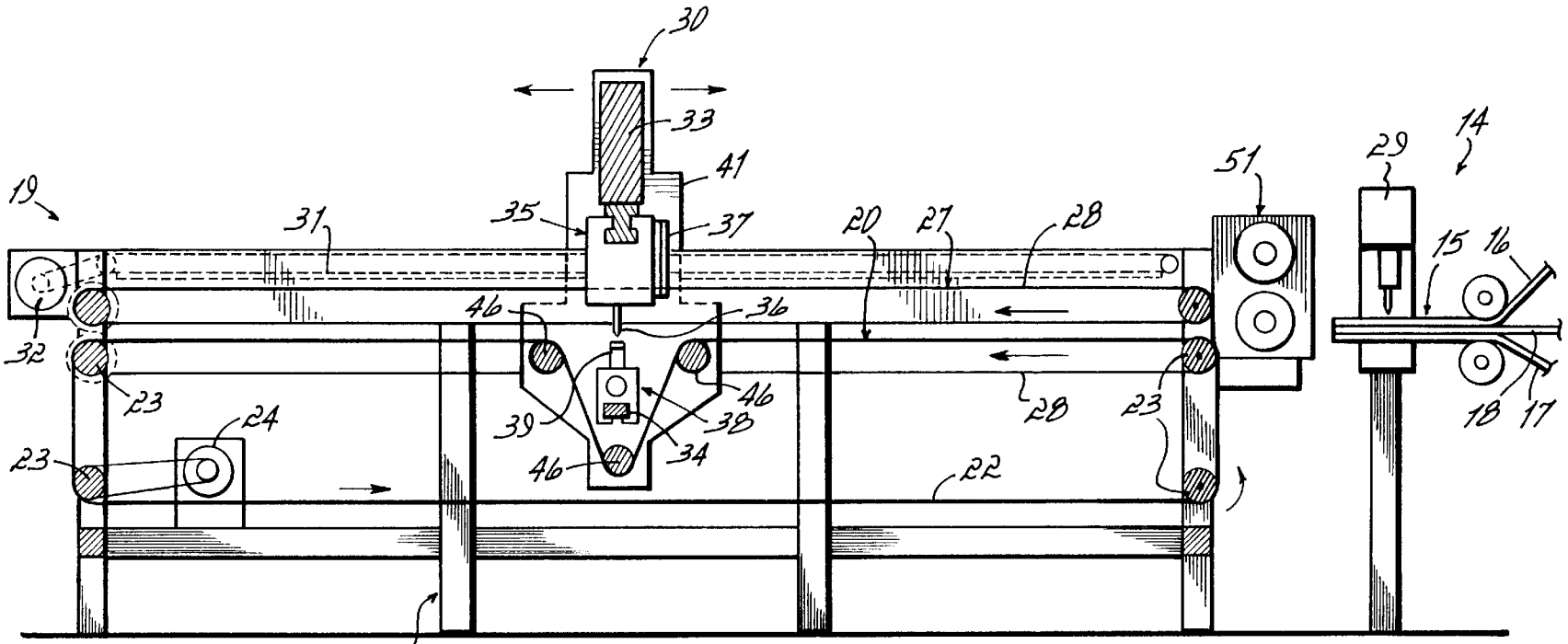
FIG. 2 is a side elevational view of the machine of FIG. 1.

FIGS. 1 and 2 illustrate a quilting machine 10 having a stationary frame 11 with a longitudinal extent represented by arrow 12 and a transverse extent represented by arrow 13. The machine 10 has a front end 14 into which is advanced a web 15 of multi-layered material that includes a facing material layer 16, a backing material layer 17 and a filler layer 18. The machine 10 also has a back end from which quilted multilayered material is advanced to a take-up or panel cutting section (not shown).

On the frame 11 is mounted a conveyor table 20 that includes a set of longitudinally extending belts 22 supported on a set of transverse rollers 23 journaled to the frame 11 to rotate thereon under the power of a drive motor 24. The motor 24 drives the belts 22 to advance the unquilted web 15 onto the frame 11 at the front end 14 thereof and to advance a quilted portion of the web 15 from the frame 11 to the take-up section at the back end 19 of the machine 10. The belts 22 support a panel of the web 15 in a horizontal quilting plane during quilting. The machine 10 also has a right side 25 and a left side 26, along each of which is mounted a side securement 27 in the form of a pair of opposed conveyor clamp belt or chain loops 28 that operate as a set of edge clamps to grip the edges of the web 15 to assist the feed of the web 15 onto and off of the frame 11 and to apply transverse tension to the web 15 in the quilting plane while a panel of the web 15 is being quilted. The securements 27 may be in the form of a series of gripping finger sets that are spaced along one of the loops 28 of the securements 27. Preferably, however, the securements 27 are each in the form of a pin chain having a plurality of pins on one of the clamp loops 28 that penetrate the web 15 and extend into holes in the other of the clamp loops 28 of the respective pair. A pair of edge stitching heads 29 is also provided, one forward of each of the side securements 27 to temporarily stitch the layers 16–18 of the web 15 together for quilting. Immediately upstream of each of the stitching heads 29 is an edge slitter for trimming excess material to the outside of the edge stitch formed by the stitching heads 29. The loops 28 are linked to move in unison with the belts 22, which are driven by the drive motor 24 on the frame 11.

Figure 4:
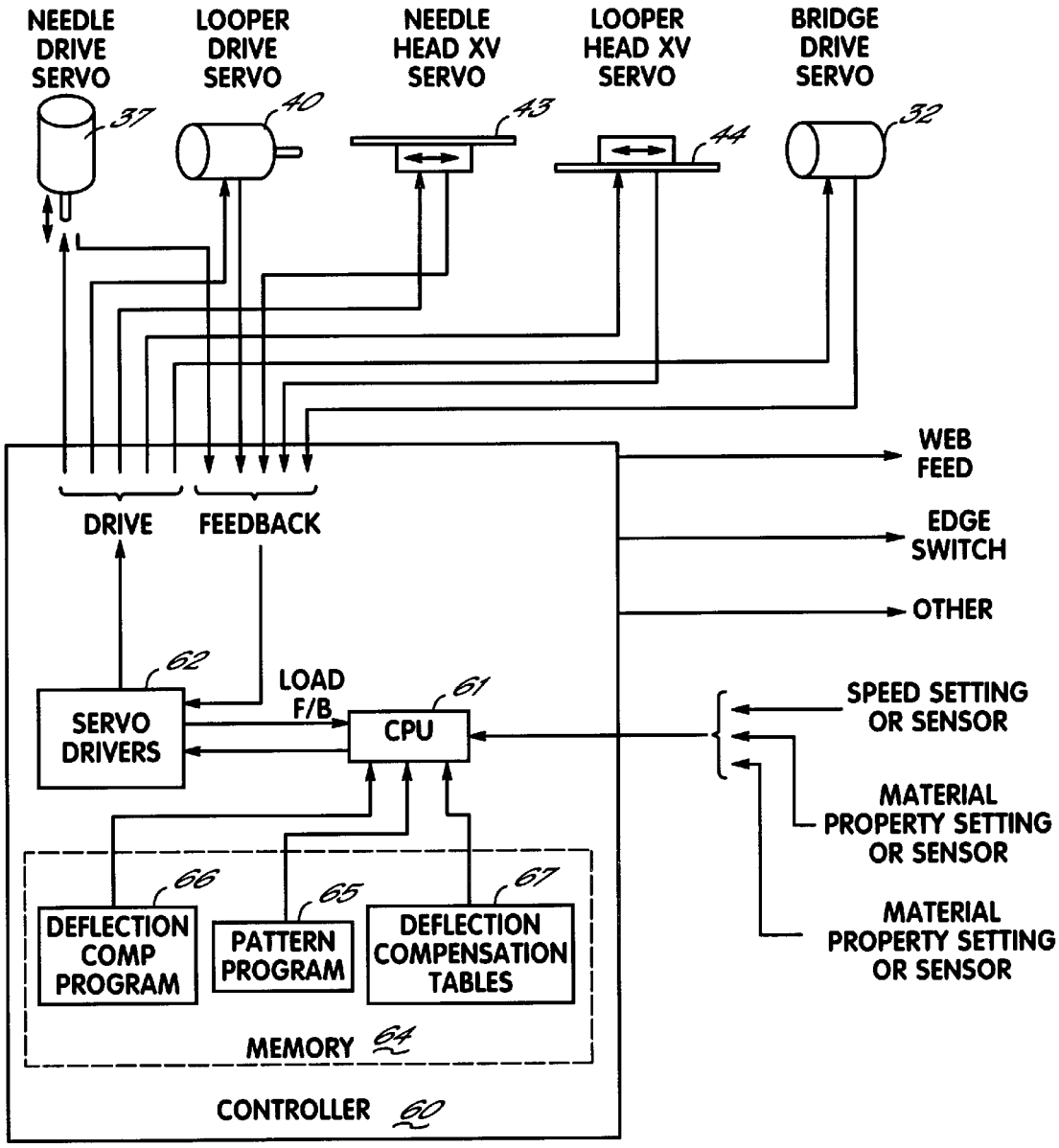
FIG. 4 is a diagrammatic representation of the control system of the machine FIG. 1.

The machine 10 has a sewing head bridge 30 mounted thereon that extends transversely across the frame 11 and is supported at each side of the frame 11 on a carriage 41. The bridge 30 and carriages 41 are each mounted to move longitudinally on the frame 11 on a pair of tracks 31 on each side of the frame 11. The bridge is driven longitudinally on the tracks 31 by a bridge drive servo motor 32, mounted on the frame 11, which is responsive to signals from a machine controller 60 (FIG. 4).

Figure 3:
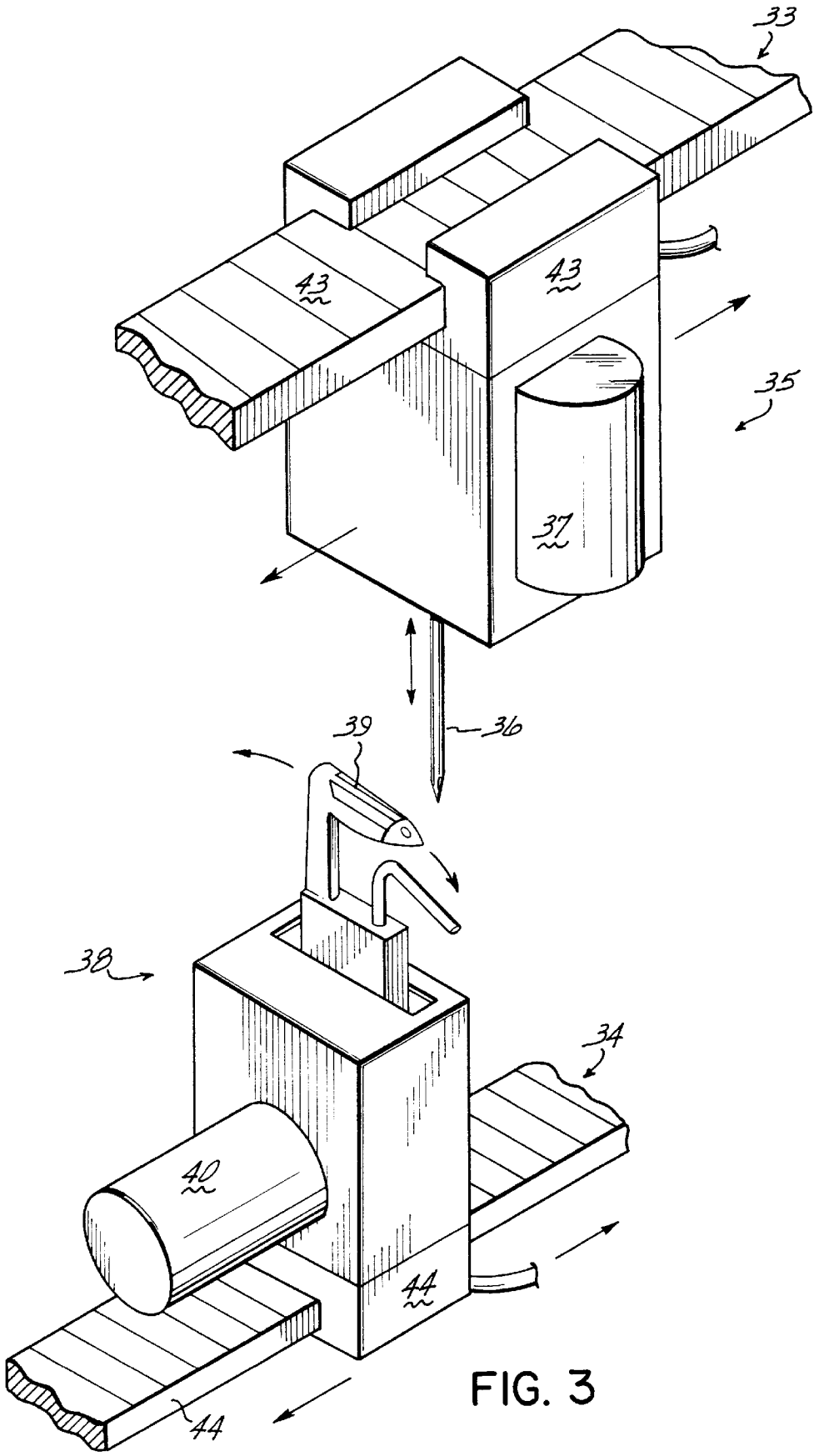
FIG. 3 is a diagrammatic perspective view of the sewing heads of the machine of FIG. 1.

The bridge 30 has a pair of transverse rails extending from one side of the frame 11 to the other, including an upper rail 33 and a lower rail 34. On the upper rail 33 is mounted an upper quilting head 35 that includes a needle 36 and a needle drive servo motor 37 (FIG. 3), which reciprocally drives the needle in a sewing cycle in response to signals from the machine controller 60. On the lower rail 34 is mounted a lower quilting head 38 that includes a looper 39 and a looper drive servo motor 40 (FIG. 3), which rocks the looper 39 in an arc in a sewing cycle, in synchronism with the motion of the needle 36 in a relationship responsive to separate signals from the machine controller 60.

The upper quilting head 35 is moveable transversely on the upper rail 33 by a linear servo motor 43 in response to signals from the controller 60, while the lower quilting head 38 is also moveable transversely on the lower rail 34 by a linear servo motor 44 in response to signals from the controller 60 independently of the upper head 35. Both of the linear servo motors 43 and 44 are preferably of the iron core type, such as the Ironcore Series of motors manufactured by Koll Morgen Motion Technologies Group of Commack, N.Y.

The bridge 30 carries a set of three idler rollers 46 that move longitudinally on the frame 11 with the bridge 30. The rollers 46 direct the belts 22 downwardly in a loop 47 below the lower rail 34 and lower quilting head 38 to permit the lower quilting head 38 to pass between the belts 22 and the web 15. The loop 47 moves with the bridge 30 and remains aligned with the bridge 30 directly below the lower quilting head 38.

The interconnection of controller 60 with the servos 32, 37, 38, 43 and 44 is diagrammatically illustrated in FIG. 4. The controller 60 includes a CPU or microprocessor 61 and a servo driver module 62. The servo driver module 62 has outputs on which signals are communicated for driving the servos 32, 37, 38, 43 and 44 and has inputs for receiving feedback signals from the servos 32, 37, 38, 43 and 44 to maintain the servos 32, 37, 38, 43 and 44 at positions calculated by CPU 61. The controller 60 also includes a non-volatile memory module 64 that includes a pattern implementation program 65, a needle deflection compensation program 66 and deflection compensation data 67, that may include lookup tables or stored constants or coefficients for use by a compensation formula in the compensation program 66. The controller 60 also has outputs to other components of the machine 10, including the web feed motors 24, the edge stitch units 29 and other machine motors and actuators not relevant to the present invention.

The controller 60 moves the bridge 30 by driving the bridge drive servo 32, and moves the linear servos 43 and 44 to move the quilting heads 35 and 38 in unison in accordance with the stitching pattern provided by the pattern program 65. These movements are carried out in coordination with the driving of the needle drive servo 37 and looper drive servo 40 to stitch patterns with stitches of controlled lengths.

In addition to the programed stitching of the patterns in accordance with the program 65, the CPU 61 modifies signals sent to the drivers 62 by differentially driving the transverse linear servos 43 and 44 to offset the needle 36 and the looper 39 transversely by a distance of preferably plus or minus approximately 0.1 inches, to an accuracy of preferably approximately 0.001 inches. The offset is determined by the CPU 61 in response to a deflection compensation program 66 and empirical data in deflection tables 67 in an amount necessary to precisely compensate for the transverse deflection of the needle 36 that is expected to occur.

Further, in accordance with the program 65, the CPU 61 also modifies signals sent to the drivers 62 by differentially driving the looper drive servo 40 so as to advance or retard the phase of the looper 39 relative to the needle 36 to longitudinally offset the loop take positions of the needle 36 and the looper 39 a phase angle of preferably plus or minus approximately 2.5° to a minimum accuracy of preferably approximately 0.25°. The offset is determined by the CPU 61 in response to a deflection compensation program 66 and empirical data in deflection tables 67 in an amount necessary to precisely compensate for the longitudinal deflection of the needle 36 that is expected to occur.

Figure 5:
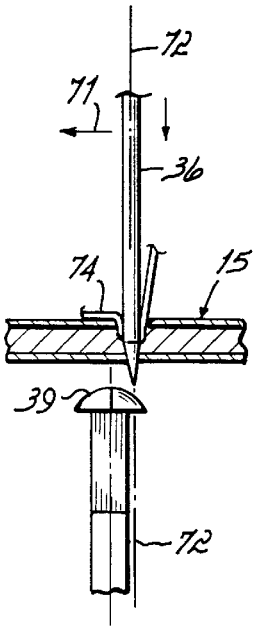
FIGS. 5–5C are sequences of diagrams representing needle deflection problems that can occur in the high speed chain stitch quilting of thick fabrics.
Figure 5A:
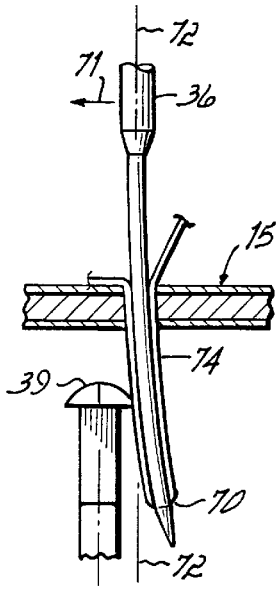
Figure 5B:
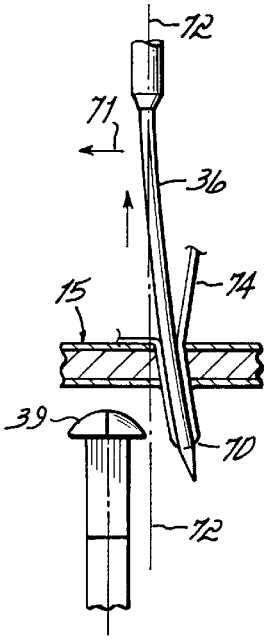
Figure 5C:
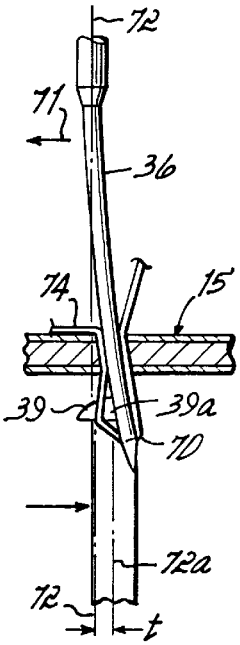

FIGS. 5–5C diagrammatically illustrates in front view a series showing how the needle 36 might deflect in transverse direction. In FIG. 5, the needle 36 is shown as it begins to pierce the web 15 in the downward part of its cycle in a portion of a pattern at which the web 15 is moving transversely relative to the needle 36, as represented by the arrows 71. At this point in the cycle, the needle 36 lies on a vertical centerline 72 of the upper head 35, which is the line of normal alignment of the needle 36 and the looper 39 that would, if the needle 36 were to remain in the plane 72, bring the needle 36 into contact with the looper 39 below the web 15. By the time the needle 36 has reached the bottom extent in its cycle, as illustrated in FIG. 5A, the relative motion of the needle 36 relative to web 15 results in a bending of the needle 36 to the right in the figure, which moves the tip of the needle 36 away from the line 72 and out of alignment with the path of the looper 39. At this point, the looper 39 is in a retracted position moving forward in a path that is supposed to pass between the needle 36 and top thread 74 that runs through the eye 70 of the needle 36. As the needle 36 ascends, as is illustrated in FIG. 5B, the needle 36 moves to a plane through which the looper 39 is moving forwardly and at which the looper 39 is supposed to pass between the needle 36 and top thread 74. However, due to the deflection of the needle 36 to the right caused by the continued motion of the web 15 relative to the centerline 72 of the upper head 35, the looper 39 misses the thread 74.

In accordance with certain embodiments of the present invention, under the conditions illustrated, the CPU 61 recognizes the needle deflection condition and determines the direction and amount of transverse deflection of the needle 36, then retrieves information 67 stored in the memory 64 and calculates the amount of compensation necessary to position the looper 39 so as to insure that the looper 39 passes between the needle 36 and the top thread 74. This amount of transverse compensation is represented by the dimension t in FIG. 5C. Movement of the lower head 38 relative to the normal position of the upper head 35 places the looper 39 in position 39*a* in a vertical line 72*a*, displaced a distance t from the line 72, that passes through the proper point for the looper 39 to pass between the needle 36 and the top thread 74.

Preferably, the CPU makes corrections by generating the main component of the signal to the servos 43 and 44 in accordance with the pattern program 65. Then, this signal is modified by the substantially smaller deflection compensation signal read by the program 66 from the table 67 that modifies one or both of the signals to the servos 43 and 44. Preferably, the modification is made to the looper head positioning servo 44.

Figure 6:
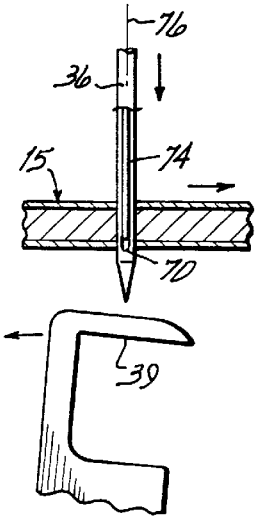
FIGS. 6–6C are sequences of diagrams representing needle deflection compensation in accordance with principles of the present invention.
Figure 6A:
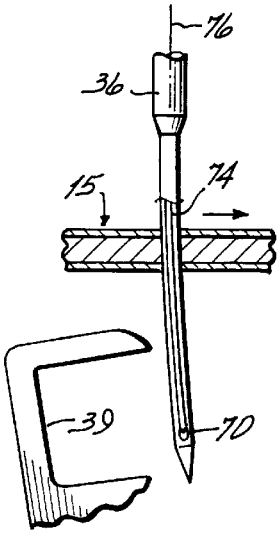
Figure 6B:
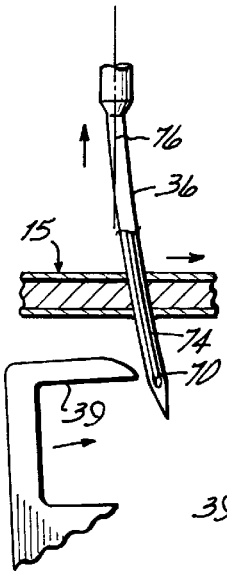
Figure 6C:
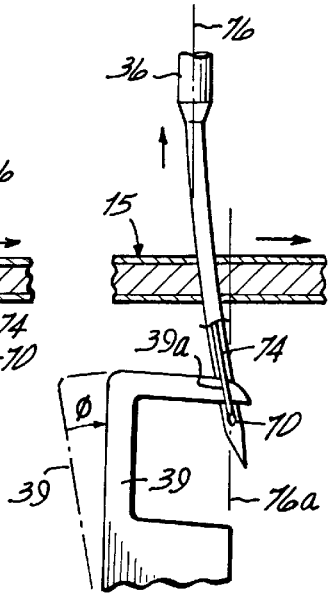

The longitudinal correction for needle compensation works in a somewhat different manner. In FIGS. 6–6C there is diagrammatically illustrated a series of side views showing how the needle 36 can deflect in the longitudinal direction. In FIG. 6, the needle 36 is shown as it begins to pierce the web 15 in the downward part of its cycle in a portion of a pattern at which the needle 36 is moving longitudinally relative to the web 15, as represented by the arrows 75. At this point in the cycle, the needle 36 lies in a vertical plane 76 that contains the vertical centerline of the upper head 35, which is the line of normal alignment of the needle 36 with the looper 39 and the line that contains the position at which the looper 39 would, if the needle 36 were to remain in the plane 76, bring the needle 36 into contact with the looper 39 below the web 15 and pass between the needle 36 and the top thread 74. By the time the needle 36 has reached the lowest point in its cycle, as illustrated in FIG. 6A, the relative motion of the needle 36 relative to the web 15 results in a bending of the needle 36 forward (to the right in FIG. 6A), which moves the needle 36 away from the plane 76 of the normal intercept point of the needle 36 with the looper 39. At this time, the looper 39 is in a retracted position moving forward in a path that is supposed to pass between the needle 36 and top thread 74 that runs through the eye 70 of the needle 36. As the needle 36 ascends, as is illustrated in FIG. 6B, the needle 36 moves to adjacent the point through which the looper 39 is moving forwardly and at which the looper 39 is intended to pass between the needle 36 and top thread 74. However, due to the deflection of the needle 36 to the right (forward) caused by the continued motion of the upper head 35 relative to the web 15, the looper 39 misses the thread 74.

In accordance with certain embodiments of the present invention, under the conditions illustrated, the CPU 61 recognizes the condition and determines the longitudinal deflection of the needle 36, then retrieves information 67 stored in the memory 64 and calculates of the amount of compensation necessary to position of the looper 39 so as to insure that the looper 39 passes between the needle 36 and the top thread 74. This amount of longitudinal compensation is in the form of an angular adjustment or relative phase angle in the drive cycles of the heads 35 and 38 as controlled by the operation of the servos 37 and 40. The phase difference is represented by the angle $\phi$ in FIG. 6C. Phasing of the looper drive 40 relative to the normal looper angle places the looper 39 in position 39*a* in a plane 76*a* that passes through the proper point for the looper 39 to pass between the needle 36 and the top thread 74.

Preferably, the CPU makes corrections by generating the main component of the signal to the servos 37 and 40 in accordance with the pattern program 65. Then, this signal is modified by the substantially smaller deflection compensation signal read by the program 66 from the table 67 that modifies one or both of the signals from the controller 60 to the servos 37 and 40. Preferably, the compensation is made to the looper drive servo 40.

Concepts of the invention may also be applied to alter the transverse motion of the upper head 35 by operation of the servo 43 or to alter the longitudinal motion of both heads 35 and 38 by affecting movement of the bridge 30 by servo 32 so as to decrease, at least in part, the amount of needle deflection. This, in effect, produces an indexing motion to the quilting heads 35 and 38 relative to the web 15, which is not fully practical in high speed quilting processes.

Details of machines 10 of the above described embodiment that are known in the art can be found in U.S. patent application Ser. No. 08/497,727, filed Jun. 30, 1995 entitled Quilting Method and Apparatus, which relates to single needle quilters but of the lock stitch type, and in U.S. Pat. No. 5,154,130, which relates to web-fed chain stitch quilters but of ganged multi-needle type, both of which are assigned to the assignee of the present invention and are hereby expressly incorporated by reference herein.

More than one set of independently driven heads may be supported on the frame 11. For example, two sets of heads

35,38 may be supported for transverse movement on the bridge 30, each separately controllable in the transverse direction and each separately drivable to stitch patterns on the web 15, with separate control thereof to compensate separately for the needle deflection that would occur at each head.

Those skilled in the art will appreciate that various changes and additions may be made to the embodiments described above without departing from the principles of the present invention.

Therefore, the following is claimed:

1. An apparatus for quilting a thick multilayered material comprising:

a rectangular frame having a front end, a back end and a pair of opposite sides;

clamping structure operable to support the material under tension in a plane on the frame;

a pair of chain stitch forming heads, including a needle head and a looper head, moveable parallel to the plane on opposite sides of the plane;

a pair of drive servo motors, one on the needle head and operable to reciprocate the needle through the material in the plane and one on the looper head and operable to reciprocate the looper in an arc adjacent the plane;

a controller operable to drive the drive servo motors in synchronized cycles to form a series of chain stitches in the material in the plane in accordance with a pattern program;

a pair of transverse head positioning servos each independently operable in response to signals from the controller;

at least one longitudinal head positioning servo operable in response to signals from the controller;

the controller including a memory in which is stored needle deflection data and a program for calculating deflections of the needle in response to operations of the heads; and the controller being operable to send signals to the servos to relatively move the needle and looper to compensate for needle deflection in the formation of the series of stitches.

2. An apparatus for quilting a thick multilayered material comprising:

a rectangular frame having a front end, a back end and a pair of opposite sides;

a plurality of rollers on the frame for directing a web of the material from a supply at the front end of the frame and to an exit at the back end of the frame, while maintaining the web in longitudinal tension on the frame;

a pair of side securements operable to support a portion of the material from the under transverse tension in a plane on the frame;

a pair of chain stitch forming heads, including a needle head and a looper head, each moveable parallel to the plane on opposite sides of the plane;

a pair of head drive servo motors, one on the needle head and operable to reciprocate the needle through the material in the plane and one on the looper head and operable to reciprocate the looper in an arc adjacent the plane;

a controller operable to drive the drive servo motors in synchronized cycles to form series of chain stitches in the material in the plane in accordance with a pattern program;

a pair of transverse head positioning linear servos each independently operable to transversely position a respective one of the heads in response to signals from the controller;

at least one longitudinal head positioning servo operable in response to signals from the controller;

the controller including a memory in which is stored needle deflection data and a program for calculating deflections of the needle in response to operations of the heads; and the controller being operable to send signals to the linear servos to relatively move the needle and looper transversely to compensate for transverse needle deflection in the formation of the series of stitches, and operable to send signals to the drive servos to relatively phase the needle and looper to compensate for longitudinal needle deflection in the formation of the series of stitches.

3. The apparatus of claim 2 further comprising:

a second pair of chain stitch forming heads, including a second needle head and a second looper head, each moveable parallel to the plane on opposite sides of the plane;

a second pair of head drive servo motors, one on the second needle head and operable to reciprocate the needle thereof through the material in the plane and one on the second looper head and operable to reciprocate the looper thereof in an arc adjacent the plane;

the controller being operable to drive the drive servo motors of the second pair in synchronized cycles to form series of chain stitches in the material in the plane in accordance with a pattern program;

a second pair of transverse head positioning linear servos each independently operable to transversely position a respective one of the second heads in response to signals from the controller;

the controller being operable to send signals to the second linear servos to relatively move the needle and looper of the second heads transversely to compensate for transverse needle deflection in the formation of the series of stitches, and operable to send signals to the second drive servos to relatively phase the needle and looper to compensate for longitudinal needle deflection in the formation of the series of stitches.

4. An apparatus for quilting a thick multilayered material comprising:

means for supporting a panel of multilayered material in a plane;

a chain stitch quilting head pair, including a needle head and a looper head, the needle head including a needle that reciprocates on the needle head approximately perpendicular to the plane and the looper head including a looper that reciprocates on the looper head in a longitudinal direction approximately parallel to the plane, the heads being moveable, relative to a panel supported in the plane and relative to each other, parallel to the plane on opposite sides of the plane;

means including a plurality of servo motors for separately operating the heads to form chain stitches in the material and for independently moving the heads relative to the panel to position the formed stitches on the panel and relative to each other; and programmed control means for operating the servos to cause the heads to quilt the material with a series of chain stitches in the shapes of predetermined patterns and to cause the heads to move differently relative to the panel to affect needle and looper alignment to achieve stitch formation when the needle deflects.

5. The apparatus of claim 4 further comprising:

means for differently adjusting the operation of the servos to independently position the heads so as to compensate for needle deflection in the formation of the stitched patterns.

6. A method of quilting a thick multilayered material comprising:

supporting a panel of multilayered material in a plane;

providing a pair of chain stitch forming heads, including a needle head having a needle that reciprocates on the needle head approximately perpendicular to the perpendicular to the plane and a looper head having a looper that reciprocates on the looper head in a longitudinal direction approximately parallel to the plane, the heads being moveable parallel to the plane on opposite sides of the plane;

providing a plurality of servo motors and separately operating the heads therewith and independently moving the heads therewith relative to the panel in accordance with a programmed pattern to quilt the pattern on the panel of multilayered material supported in the plane with a series of chain stitches formed by the motion of the needle and the looper; and differently controlling the servos in accordance with the changes in the deflection of the needle as the pattern is quilted to cause the heads to form the series of chain stitches while maintaining the needle and looper in alignment.

7. The method of claim 6 further comprising the step of:

differently adjusting the operation of the servos to independently position the heads so as to compensate for needle deflection in the formation of the stitched patterns.

8. The method of claim 6 further comprising the step of:

feeding a plurality of layers of fabric into the plane and assembling a panel of the multilayered material therefrom to be supported in the plane for quilting;

differently adjusting the operation of the servos to independently position the heads parallel to the plane so as to compensate for needle deflection in the formation of the stitched patterns.

9. The method of claim 6 further comprising the step of:

controlling the servos to adjust the phase of the looper relative to the needle to compensate for longitudinal deflection of the needle.

10. The method of claim 6 further comprising the step of:

controlling the servos to adjust the transverse position of one head relative to the other head to compensate for transverse deflection of the needle.

11. The method of claim 6 further comprising the steps of:

storing in a memory information to compensate for deflection of the needle; and controlling the servos to, in response to the stored information to correct for the deflection of the needle, thereby maintain the needle and looper in alignment.

12. The method of claim 6 further comprising the steps of:

sensing information responsive to deflection of the needle; and controlling the servos to, in response to the sensed information to correct for the deflection of the needle, thereby maintain the needle and looper in alignment.

13. The apparatus of claim 4 further comprising:

a web feed mechanism positioned to direct multiple layers of fabric into the plane from which the panel of multilayered material can be supported in the plane for quilting.

14. The apparatus of claim 4 further comprising:

the means for separately operating and independently moving the heads includes means operable to change the phase of the looper relative to the needle; and the programmed control means includes means for operating the servos to adjust the phase of the looper relative to the needle to compensate for longitudinal deflection of the needle.

15. The apparatus of claim 4 further comprising:

the means for separately operating and independently moving the heads includes means operable to move one head transversely relative to the other head; and the programmed control means includes means for operating the servos to adjust the transverse position of one head relative to the other head to compensate for transverse deflection of the needle.

16. The apparatus of claim 4 wherein the programmed control means further comprises:

memory means for storing correction information used by the controller to control the heads to compensate for deflection of the needle.

17. The apparatus of claim 4 wherein the programmed control means further comprises:

sensing means for acquiring correction information for use by the controller to control the heads to compensate for deflection of the needle.

* * * * *